US005943889A

United States Patent [19]

Chiu

[11] Patent Number: 5,943,889

[45] Date of Patent: Aug. 31, 1999

[54] COLLAPSIBLE KEY ASSEMBLY

[76] Inventor: Kuang-Yen Chiu, P.O. Box 82-144, Taipei, Taiwan

[21] Appl. No.: 09/035,155

[22] Filed: Mar. 5, 1998

[51] Int. Cl.[6] ..... A44B 15/00

[52] U.S. Cl. ..... 70/456 R; 70/459

[58] Field of Search ..... 70/456 R–459; D3/207–212; 24/3.6

[56] References Cited

U.S. PATENT DOCUMENTS

| | | | |
|---|---|---|---|
| 2,029,696 | 2/1936 | Bennett | 70/456 R |
| 2,047,331 | 7/1936 | Pollack | 70/456 R |
| 2,051,935 | 8/1936 | Bennett | 70/456 R |
| 2,462,206 | 2/1949 | Magee | 70/456 R |
| 2,517,500 | 8/1950 | McPherson et al. | 70/456 R |
| 2,652,712 | 9/1953 | Hoag | 70/456 R |
| 2,822,684 | 2/1958 | Ray | 70/456 R |
| 2,851,872 | 9/1958 | Stow | 70/456 R |
| 3,023,603 | 3/1962 | Bowen | 70/456 R |
| 3,173,280 | 3/1965 | Oberacker | 70/456 R |
| 3,321,943 | 5/1967 | Reyes | 70/456 R |
| 4,660,397 | 4/1987 | Girimont | 70/456 R |

FOREIGN PATENT DOCUMENTS

| | | | |
|---|---|---|---|
| 687893 | 2/1940 | Germany | 70/456 R |
| 1286400 | 8/1972 | United Kingdom | 70/456 R |

*Primary Examiner*—Suzanne Dino Barrett

[57] ABSTRACT

A collapsible key assembly includes a housing including a positioning member, a first cover fixedly mounted on one side of the positioning member, a second cover fixedly mounted on another side of the positioning member, a pin fixedly fitted in a circular through hole of the positioning member and having two ends extending therethrough, a U-shaped spring having two coiled arms each having two straight ends, two keys pivotally mounted on two ends of the pin and bearing against the two coiled arms of the spring, two packing rings fitted on two ends of the pin, and two buttons fitted on two ends of the pin and bearing against the packing rings, whereby the keys can be easily folded into the housing when not in use.

1 Claim, 3 Drawing Sheets

COLLAPSIBLE KEY ASSEMBLY

BACKGROUND OF THE INVENTION

1. Field of the Invention

This invention is related to a collapsible key assembly and in particular to one which enables keys to be folded into a case when not in use.

2. Description of the Prior Art

It has been found that the conventional key cannot be folded when not in use thereby making it inconvenient to carry. Furthermore, the blade portion of the conventional key is made of metal and will often cause injuries to children. Hence, a key case is generally used to receive conventional keys in order to prevent them from causing damage to the clothes or the like, thereby causing expenditure and causing inconvenience in use.

Therefore, it is an object of the present invention to provide a collapsible key assembly which can obviate and mitigate the above-mentioned drawbacks.

SUMMARY OF THE INVENTION

This invention is related to a collapsible key assembly.

It is the primary object of the present invention to provide a collapsible key assembly which enables keys to be folded into a case when not in use.

It is another object of the present invention to provide a collapsible key assembly which can protect a user from being injured by a key.

It is still another object of the present invention to provide a collapsible key assembly which is convenient to carry.

It is still another object of the present invention to provide a collapsible key assembly which is easy to manufacture.

It is a further object of the present invention to provide a collapsible key assembly which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
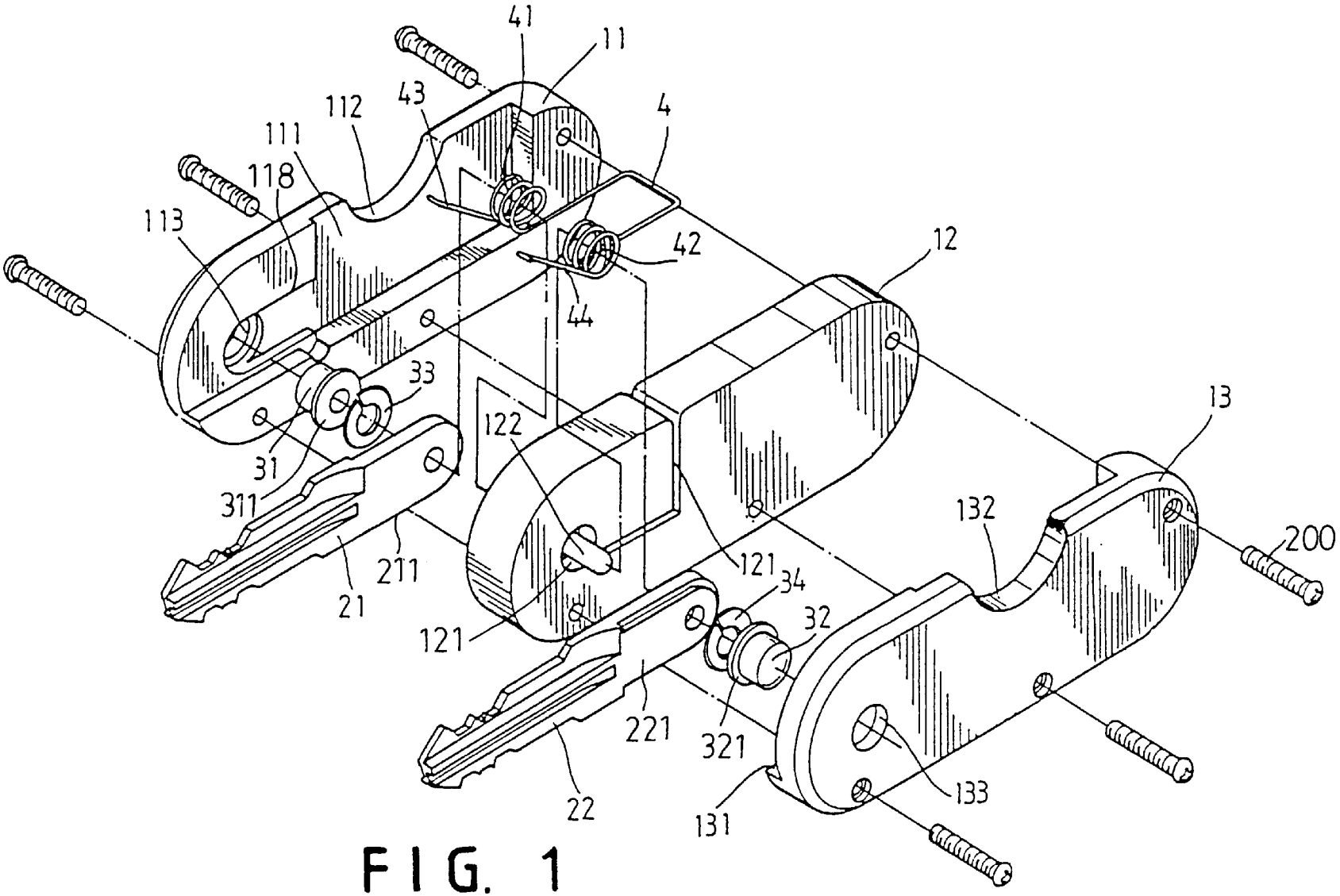
FIG. 1 is an exploded view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
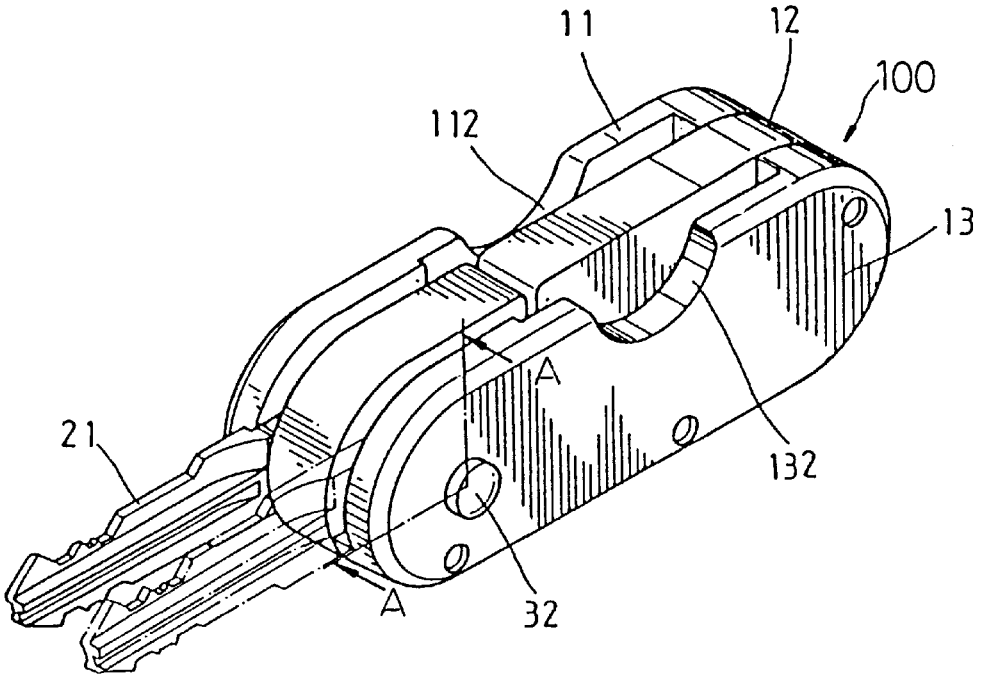
FIG. 2 is a perspective view of the present invention.
Figure 3:
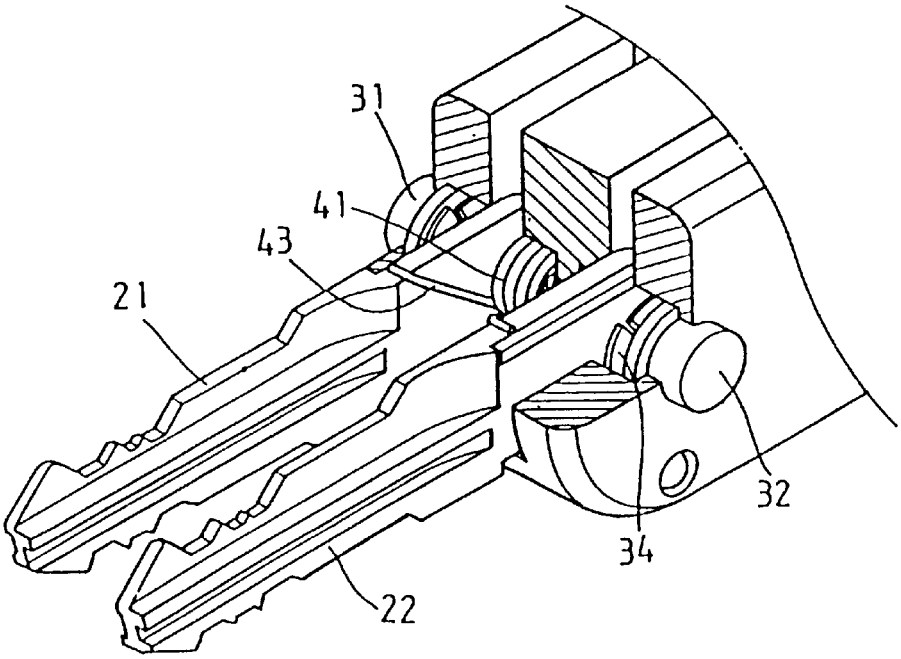
FIG. 3 is an enlarged fragmentary view taken along line 3—3 of FIG. 2.

With reference to the drawings and in particular to FIGS. 1, 2 and 3 thereof, the collapsible key assembly according to the present invention generally comprises a housing 100 which includes a first cover 11, a positioning member 12, a second cover 13, two keys 21 and 22, and a spring 4. The positioning member 12 is arranged between the first and second covers 11 and 13. The first cover 11 and the second cover 13 are symmetric in structure. The first and second covers 11 and 13 are formed with L-shaped recesses 111 and 131 at the inner side, curved notches 112 and 132 at the top, and circular through holes 113 and 133 close to the front end, respectively. Two buttons 31 and 32 are inserted in the holes 113 and 133 from the inner sides of the left and right covers 11 and 13, respectively. The buttons 31 and 32 have flanges 311 and 321 which are larger than the circular through holes 113 and 133 of the first and second covers 11 and 13 in diameter so that the buttons 31 and 32 will not completely go therethrough. The positioning member 12 is formed with a vertical slit 121 adapted to receive an end of the spring 4 and a circular hole 121 close to the front end thereof. The circular hole 121 of the positioning member 12 is aligned with the circular holes 113 and 133 of the first and second covers 11 and 13. A pin 122 is fitted in the circular hole 121 of the positioning member 12 and has two ends extending out of two sides of the positioning member 12. Two keys 21 and 22, two packing rings 33 and 34 and two buttons 31 and 32 are put onto the two ends of the pin 122 in sequence. The buttons 31 and 32 extend partially out of the holes 113 and 133 of the first and second covers 11 and 13. The spring 4 is a U-shaped member having two coiled arms 41 and 42 formed with two straight ends 43 and 44. The spring 4 is engaged with the positioning member 12, with its bottom fitted in the slit 121 of the positioning member 12, its two coiled arms 41 and 42 fitted over the two ends of the pin 122 and located between the keys 21 and 22 and the two sides of the positioning members 12, and its two ends 43 and 44 bearing against the inner side of the two keys 21 and 22.

Figure 5:
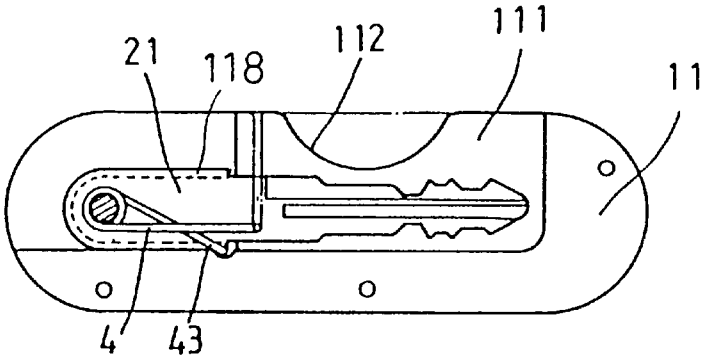
FIG. 5 illustrates the closed condition of the present invention.
Figure 4:
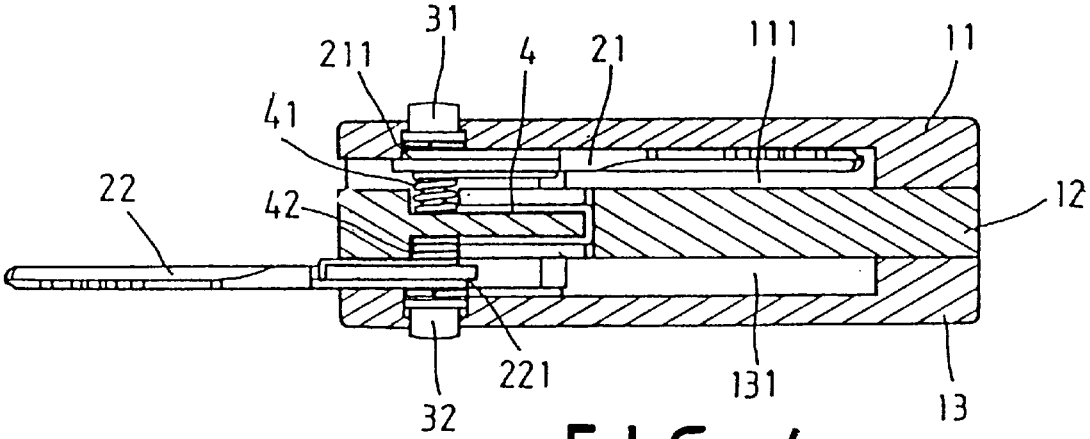
FIG. 4 is a sectional top view of the present invention.
Figure 6:
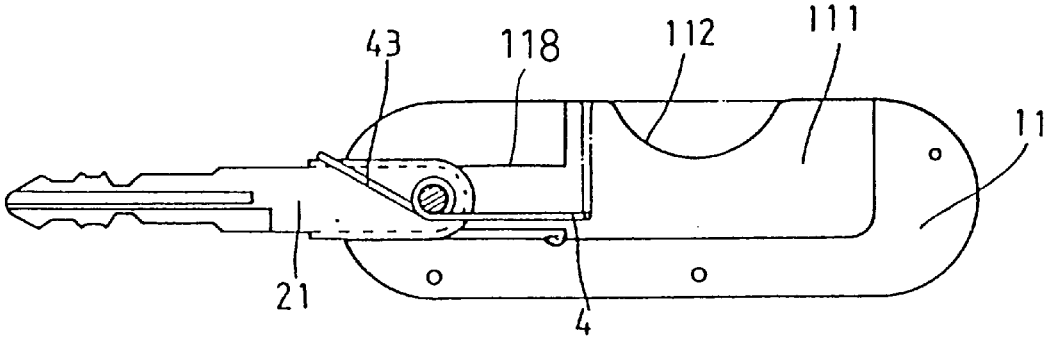
FIG. 6 illustrates the opened condition of the present invention.

As shown in FIGS. 4, 5 and 6, the key 21 is pushed by the coiled arm 41 of the spring 4 into the L-shaped recess 111 of the first cover 11 so that the shank 211 of the key 21 will be blocked by the edge 118 of the L-shaped recess 111 thereby keeping the key 21 in place. When desired to use the key 22, it is only necessary to depress the button 32 to release the shank 221 of the key 22 from the edge 118 of the L-shaped recess 131 so that the coiled arm 42 of the spring 4 will force the key 22 to go out of the second cover 13. Similarly, when desired to collapse the keys, simply fold the keys 21 and 22 into the first and second covers 11 and 13 and then force the keys 21 and 22 outwardly so that the keys 21 and 22 will be blocked by the edges 118 of the L-shaped recesses 111 and 131 of the first and second covers 11 and 13 thereby keeping the keys 21 and 22 in place.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A collapsible key assembly comprising:

a housing including a positioning member, a first cover fixedly mounted on one side of said positioning member, a second cover fixedly mounted on another side of said positioning member, said positioning member having an intermediate portion formed with a vertical slit and an end formed with a circular through hole, said first and second covers being symmetric in structure, each of said covers having an inner side formed with a L-shaped recess, a top formed with a curved notch, and a circular through hole close to an end of said covers and aligned with said circular through hole of said positioning member;

a pin fixedly fitted in said circular through hole of said positioning member and having two ends extending through said circular through hole of said positioning member;

a U-shaped spring having two coiled arms each having two straight ends, said U-shaped spring having a bottom portion fitted in said vertical slit of said positioning member, said two coiled arms of said U-shaped spring being fitted over said two ends of said pin;

two keys pivotally mounted on said two ends of said pin and bearing against said two coiled arms of said spring, each of said keys having a shank fitted in a horizontal portion of said L-shaped recess of said covers;

two packing rings fitted on said two ends of said pin and bearing against said keys; and two buttons fitted on said two ends of said pin and bearing against said packing rings, said buttons extending partially out of said circular through holes of said covers.

* * * * *